United States Patent [19]

Moeller

[11] 3,998,294

[45] Dec. 21, 1976

[54] CONNECTING DEVICE ADAPTED TO MAINTAIN AN OBJECT AT A SELECTED DISTANCE FROM A WALL

[76] Inventor: Melvin A. Moeller, 282 Stenzil St., North Tonawanda, N.Y. 14121

[22] Filed: Feb. 4, 1976

[21] Appl. No.: 655,254

[52] U.S. Cl. ..... 182/229; 248/354 R

[51] Int. Cl.[2] ..... E04H 17/00; E04G 25/04

[58] Field of Search ..... 182/229, 82; 248/354 S, 248/354 R

[56] References Cited

UNITED STATES PATENTS

| | | | |
|---|---|---|---|
| 2,725,210 | 11/1955 | Swartz | 248/354 S |
| 3,006,592 | 10/1961 | Davis | 248/354 S |
| 3,120,878 | 2/1964 | Neeley | 182/82 |
| 3,171,627 | 3/1965 | Tapley | 248/354 |
| 3,521,758 | 7/1970 | Guilfoyle | 248/354 S |
| 3,903,991 | 9/1975 | Phelan | 182/229 |

*Primary Examiner*—Reinaldo P. Machado
*Attorney, Agent, or Firm*—Sommer & Sommer

[57] ABSTRACT

A connecting device is adapted to maintain an object, such as a scaffold assembly, at a selected spaced distance from a wall. The device includes a first tubular member having one end connected to the wall, and a second tubular member having one end connected to the object. The other ends of the first and second members are telescopically received in a third tubular member. The position of the first member may be longitudinally adjusted relative to the third member to provide a coarse adjustment of length. The second member is rotatably joined to the third member. A threaded engagement is provided between the first member and a stationary member mounted on the wall. A fine adjustment of length may be obtained by rotating the third member relative to the second member.

9 Claims, 6 Drawing Figures

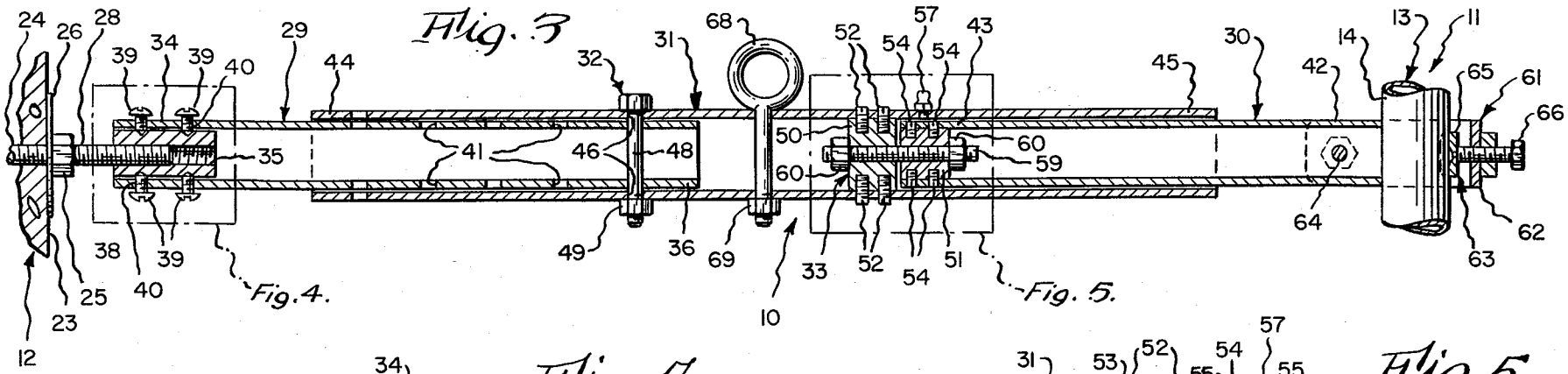
Fig. 3
Fig. 4.
Fig. 5.
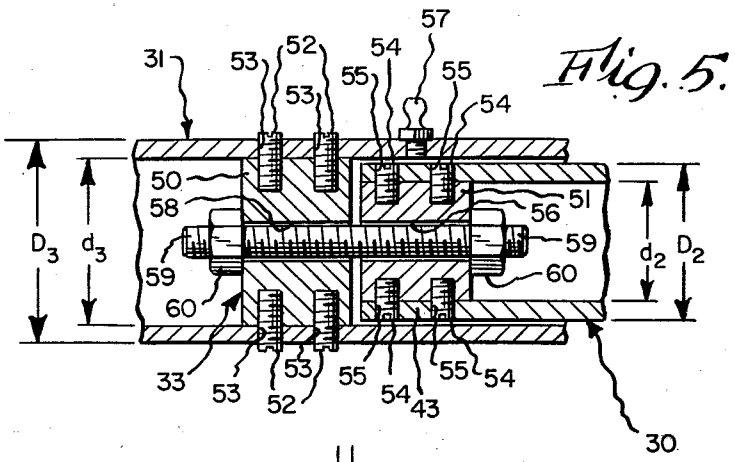
Fig. 5.
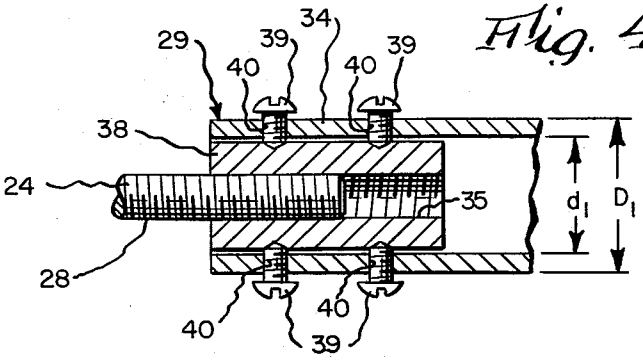
Fig. 4.
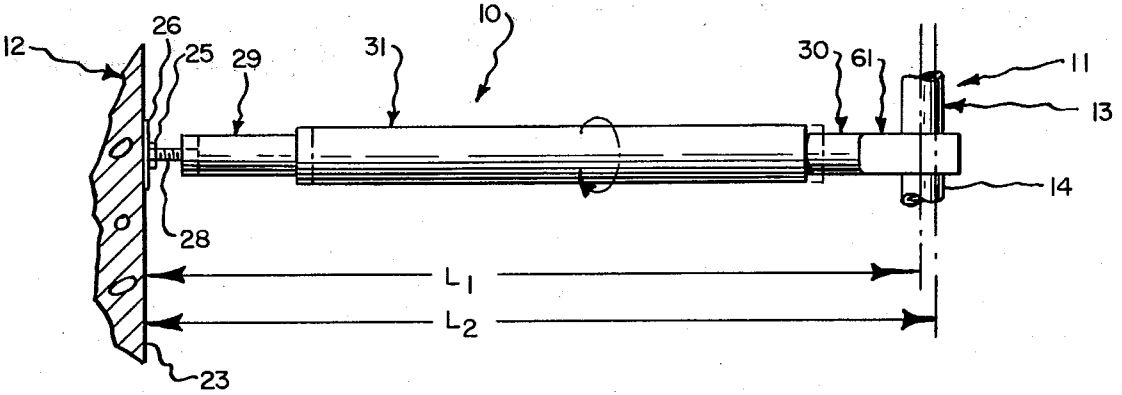
Fig. 6.

CONNECTING DEVICE ADAPTED TO MAINTAIN AN OBJECT AT A SELECTED DISTANCE FROM A WALL

BACKGROUND OF THE INVENTION

1. Field of the Invention

The present invention relates generally to a connecting device adapted to maintain an object at a selected spaced distance from a wall, and more particularly to an improved connecting device which is adapted to hold a scaffold assembly at such a selected spaced distance from a wall.

2. Description of the Prior Art

Heretofore, upon information and belief, it has been known to couple or join a scaffold assembly to a wall by expedient means, such as by tying a rope or wire. However, inasmuch as such scaffold assemblies may be used to support heavy loads, such as a pile of bricks, at an off center location, an overturning moment may be applied to the scaffold assembly.

For obvious safety reasons, it is generally desired that such a scaffold assembly be securely supported to provide a stable work platform for persons thereon.

SUMMARY OF THE INVENTION

The present invention provides an improved connecting device which is adapted to maintain an object, such as a scaffold assembly, at a selected spaced distance from a wall, where one of the object and wall is provided with a member having a stationary threaded portion operatively arranged to face the other of the object and wall.

The connecting device broadly includes an elongated first member having one marginal end portion provided with a cooperative threaded portion adapted to matingly engage the stationary threaded portion, and having another marginal end portion; an elongated second member having one marginal end portion secured to the other of said object and wall, and having another marginal end portion; an elongated third member arranged to overlap each of such other marginal end portions of the first and second members; interlock means arranged to secure the first and third members together at any selected one of a plurality of longitudinally-spaced relative incremental positions therebetween for adjustably fixing the extent of overlap between the first and third members; and rotation means operatively arranged between the second and third members for preventing substantial relative longitudinal movement therebetween, but for permitting the third member to be freely rotated relative to the second member; whereby the length of the connecting device may be coarsely varied by adjusting the interlock means to vary the extent of overlap between the first and third members, and may be finely adjusted by rotating the third member relative to the second member.

The first and third members may each be substantially cylindrical tubular members, with one of the first and third members telescopically received in the other of such members. The adjustment means may include a plurality of longitudinally-spaced through holes provided through one of the first and third members, at least one cooperative hole provided through the other of such members, and a suitable fastener, or equivalent, having a portion passed through the cooperative hole and any selected one of the plurality of holes to releasably hold or fix the first and third means together.

Each of the second and third members may be substantially tubular, with one of these members telescopically received in the other. The rotation means may generally comprise a third plug member arranged within and secured to the third member, a second plug member arranged within and secured to the second member, and a fastener, or equivalent, passing through these plug members and operatively arranged to prevent substantial axial movement between the second and third members, but enabling free relative rotation therebetween.

Accordingly, one general object of the present invention is to provide a connecting device for maintaining or holding an object at a selected spaced distance from a wall.

Another object is to provide an improved connecting device which is particularly adapted to maintain a scaffold assembly at a selected spaced distance from a wall.

Another object is to provide an improved connecting device for holding a scaffold assembly to a wall, the length of which device may be selectively varied to maintain the scaffold assembly at the desired spaced distance from the wall.

Another object is to provide an improved connecting device of the type described, which permits both coarse and fine adjustments of its length.

Still another object is to provide an improved connecting device which is inexpensive to manufacture, and which provides a more facile combination of structure than that heretofore known in the prior art.

These and other objects and advantages will become apparent from the foregoing and ongoing specification, the drawings and the appended claims.

BRIEF DESCRIPTION OF THE DRAWINGS

FIG. 3 is an enlarged fragmentary longitudinal vertical sectional view of a connecting device, taken generally on line 3—3 of FIG. 2, this view principally showing the first, second and third members, the interlock means, the rotation means, and the clamp means.

FIG. 4 is a further enlarged fragmentary longitudinal vertical sectional view of the structure contained within the indicated box of FIG. 3, showing the first plug member arranged within the left marginal end portion of the first member.

FIG. 5 is a further enlarged fragmentary longitudinal vertical sectional view of the structure contained within the indicated box of FIG. 3, this view particularly showing the rotation means as including the second and third plug members.

FIG. 6 is a fragmentary side elevation of a connecting device, this view showing, in solid, one desired length of the connecting device, and showing, in phantom, another desired length of the connecting device after the third member has been rotated relative to the second member.

DESCRIPTION OF THE PREFERRED EMBODIMENT

Figure 2:
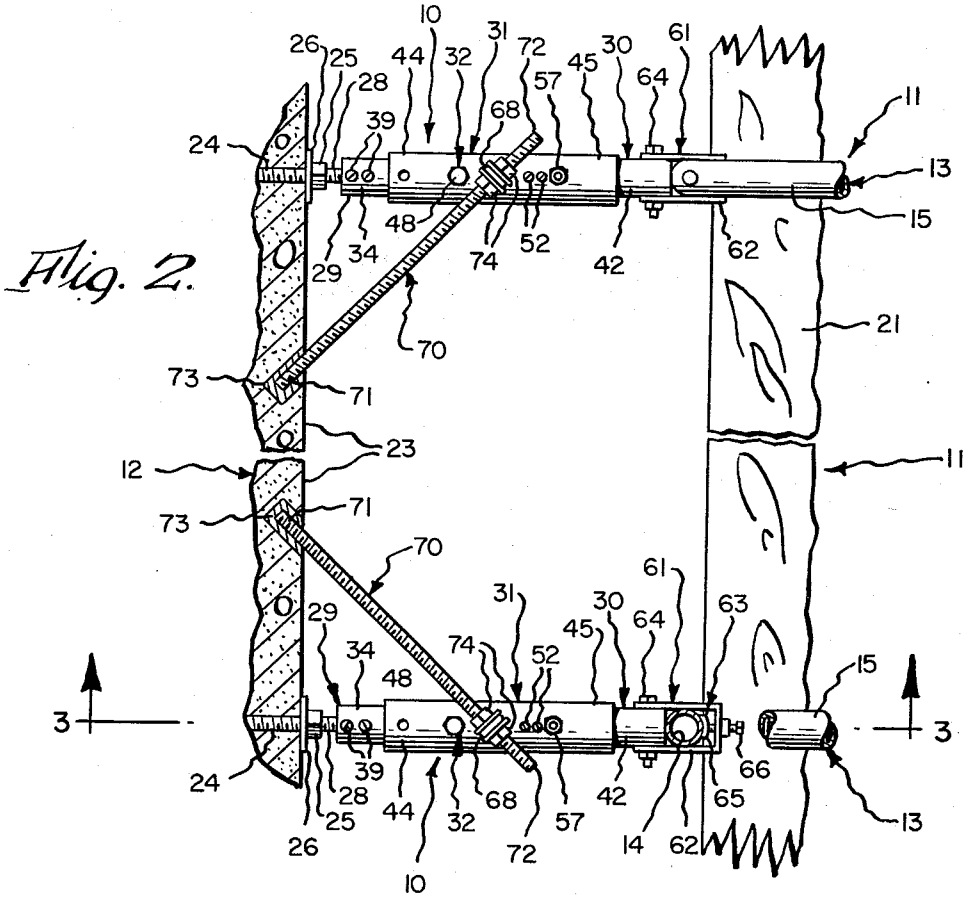
FIG. 2 is a top plan view thereof, taken generally on line 2—2 of FIG. 1, showing two horizontally-spaced connecting devices operatively arranged to maintain such selected spacing between the wall and scaffold assembly, this view further showing a brace operatively associated with each connecting device to prevent unintended rotation of the third member relative to the second member.

At the outset, it should be clearly understood that like reference numerals are intended to indentify the same elements and/or structure consistently throughout the several drawing figures, as such elements and/or structure may be further described or explained by the entire written specification of which this detailed description is an integral part.

Figure 1:
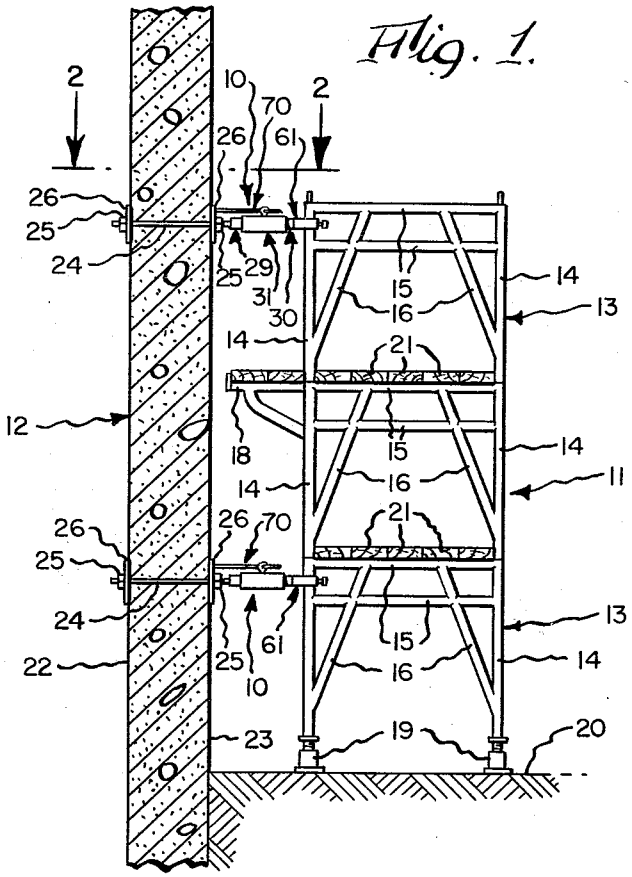
FIG. 1 is a view showing two vertically-spaced inventive connecting devices operatively arranged to maintain an object, such as a scaffold assembly, at a selected spaced distance from a wall, this view further showing the wall as including a member having a stationary threaded portion arranged to face the scaffold assembly.

Referring initially to FIG. 1, the present invention provides a connecting device, of which the presently preferred embodiment is generally indicated at 10, which is adapted to maintain an object, such as a scaffold assembly, generally indicated at 11, at a selected spaced distance from a wall, generally indicated at 12.

This scaffold assembly 11 is of known type, and is shown in elevation (FIG. 1) as including a plurality of scaffold sections 13, also known as "bedsteads", three of these bedsteads being illustrated in FIG. 1. In the well known manner, each bedstead 13 includes a pair of horizontally-spaced vertical legs 14, a pair of vertically-spaced horizontal cross-members 15, and an inclined brace 16 interconnecting each leg with members 15 to rigidify the scaffold section. Moreover, the intermediate or middle bedstead 13 is shown as further including a side arm 18, and a leveling jack 19 is provided between the grade line 20 and the lower marginal end portions of bottom bedstead legs 14, 14. Of course, these stacked bedsteads are provided along the wall at suitable increments, and are suitably interconnected by diagonal braces (not shown) to rigidify the entire scaffold assembly 11. Thereafter, wooden planks or boards 21 are positioned on the bedsteads and side arm 18, as necessary, to provide a suitable work platform, two of these platforms being shown in FIG. 1. However, it should be clearly understood that the illustrated scaffold assembly 13 constitutes only one common species of known scaffold assemblies, and the appended claims should not be limited to this particular illustrated embodiment. Moreover, the present invention is not limited to use with scaffold assemblies, and possesses greater utility to maintain other types of objects at a selected spaced distance from a wall. Accordingly, as used herein, the word "object" is intended in its full generic sense, and should not necessarily be limited to scaffold assemblies.

Still referring principally to FIG. 1, the wall 12 is representatively shown as being formed of concrete, and as having a planar vertical left surface 22, and a planar vertical right surface 23. Here again, the word "wall", as used herein, is intended in its full generic sense, and should not be limited to the particular wall or type of construction herein illustrated and described. Thus, the word wall may include other types of construction, which may or may not be vertical.

As previously mentioned, the present invention provides a connecting device to which is adapted to maintain an object, such as scaffold assembly 11, at a selected or desired spaced distance from a wall, such as vertical wall 12. In the illustrated embodiment, the connecting device 10 serves to operatively connect or secure the scaffold assembly 13 to wall 12 to prevent unintended movement of the scaffold assembly toward or away from the wall for obvious safety reasons. To this end, two of the inventive connecting devices 10 are shown associated with the wall and object in FIG. 1, although this is illustrative only and not limitative of the scope of the appended claims.

Referring now to FIGS. 1, 2 and 3, a plurality of externally-threaded horizontal rods, severally indicated at 24, are shown as penetrating holes suitably provided through the wall, such that the marginal end portions of these rods extend outwardly beyond the wall surfaces. Each of these rods 24 is secured in this position by a pair of nuts 25 suitably threaded onto the rods, and arranged to act on the wall through a large diameter flat washer 26. Thus, by suitably tightening each of nuts 25, the rods 24 may be secured in the position shown, with the right marginal end portion of each rod 24 extending rightwardly beyond its associated nut to provide a stationary threaded portion 28 arranged to face the object 11 (FIG. 2, 3 and 6).

Referring now principally to FIG. 3, the inventive connecting device 10 is shown as broadly including an elongated first member, generally indicated at 29; an elongated second member, generally indicated at 30; an elongated third member, generally indicated at 31; interlock means, generally indicated at 32; and rotation means, generally indicated at 33.

As best shown in FIGS. 1 and 4, the first member 29 is depicted as being a horizontally-elongated open-ended hollow cylindrical tubular member having an inside diameter $d_1$ and an outside diameter $D_1$ (FIG. 4). This first member 29 has one marginal end portion 34 (adjacent its left end in FIG. 3) provided with a cooperative internally-threaded portion 35 adapted to matingly engage the exposed threaded portion 28 of a rod 24, and has another marginal end portion 36 (at its right end in FIG. 3). In the illustrated embodiment, a cylindrical first plug member 38 is shown arranged within the first member left marginal end portion 34, and is secured in this position by a plurality of screw fasteners, severally indicated at 39, having their threaded shank portions matingly received in tapped holes 40 provided through the first member left marginal end portion, and having their inner ends operatively engaging first plug member 38. Thus, these set screws 39 may be suitably tightened to securely hold this first plug member 38 within first member left marginal end portion 34. In this illustrated embodiment, the cooperative internally-threaded portion 35 is provided on first plug member 38, although such cooperative threaded portion 35 could be provided directly on the first tubular member 29, if denied. Moreover, this first member 29 is shown further provided with a plurality of longitudinally-spaced pairs of diametrically-aligned through holes, severally indicated at 41, for a purpose hereinafter explained.

Referring now to FIGS. 1 and 5, the second member 30 is depicted as being a horizontally-elongated open-ended hollow cylindrical tubular member having an inside diameter $d_2$ and an outside diameter $D_2$. This second member 30 has one marginal end portion 42 (adjacent its right end in FIG. 3) secured to the object 11, and has another marginal end portion 43 (adjacent its left end in FIG. 3).

The third member 31 is also shown as being a horizontally-elongated open-ended hollow cylindrical tubular member having an inside diameter $d_3$ greater than the outside diameters of the first and second members, $D_1$ and $D_2$, respectively, and having an outside diameter $D_3$ (FIG. 5). This third member 31 has a left marginal end portion 44 arranged to overlap the right marginal end portion 36 of the first tubular member, and has a right marginal end portion 45 arranged to overlap the left marginal end portion 43 of the second tubular member. Specifically, the first member right marginal end portion 36 is slidably and telescopically received in this third member through the left end thereof, and the second member left marginal end portion 43 is slidably and telescopically received in the third member through the right end thereof.

The interlock means 32 is arranged to secure the first and third members together at any selected one of a plurality of longitudinally-spaced incremental relative positions therebetween for adjustably fixing the extent of overlap between the first and third members. To this end, the interlock means 32 includes the plurality of longitudinally-spaced diametral holes 41 provided through the first member; a cooperative pair of diametrically-opposed holes 46 provided through the third member; and a suitable fastener, such as bolt 48, having its shank portion suitably arranged to pass through the cooperative holes 46 and any selected pair of the longitudinally-spaced holes 41, and further adapted to be releasably secured in this operative position by a nut 49 suitably threaded onto its end portion. Thus, nut 49 may be selectively removed to permit the fastener to be withdrawn. Thereafter, the first member may be moved longitudinally relative to the third member to any position at which cooperative holes 46, 46 are aligned with any diametrical pair of holes 41, after which the fastener may be reinserted through these holes, and retained in this new position by application of nut 49. In this manner, the interconnecting means affords the capability of coarsely adjusting the length of the device 10, and effectively joins or secures the first and third members together at such selected coarse length. Of course, it will be appreciated that the first and third members will rotate together, when so joined.

Adverting now principally to FIG. 5, the rotation means 33 is shown operatively arranged between the second and third members for preventing substantial relative longitudinal movement therebetween, but for permitting the third member to be freely rotated relative to the second member. In the preferred embodiment, the rotation means 33 comprises a third plug member 50 arranged within and secured to the third member 31, and a second plug member 51 arranged within and secured to the left marginal end portion 43 of the second member. The third plug member 50 is retained within and secured to the third member by a plurality of radially-extending set screws, severally indicated at 52, which penetrate tapped holes 53 provided through the third member and engage the third plug member 50. Similarly, the second plug member 51 is retained within and secured to second member left marginal end portion 43 by a plurality of radially-extending set screws, severally indicated at 54, which penetrate tapped holes 55 provided through the second member left marginal end portion 43 to engage the second plug member 51. Each of second and third plug members 51, 50 is provided with an axial through hole, 56, 58, respectively, which are adapted to register with one another. Still referring to FIG. 5, the rotation means 33 is shown as further including a suitable fastener passing through aligned holes 56. 58. This fastener is illustrated as including an externally-threaded rod 59 provided with a nut 60 at either end. This fastener operates to prevent substantial relative longitudinal or axial movement between the second and third members, while simultaneously permitting the third member to be freely rotated relative to the second member. To facilitate and enhance such relative rotation between the second and third members, the third member is shown as further provided with a grease fitting 57 to enable lubrication of the rotation means.

Referring now to FIGS. 2 and 3, the inventive device 10 may further include clamp means, generally indicated at 61, operatively arranged between the second member right marginal end portion 42 and the object 11. In FIG. 2, the clamp means is shown as including a U-shaped member 62 having the distal ends of its spaced legs arranged to overlap the second member right marginal end portion 42, and having a clamp 63 operatively associated with its base. A suitable fastener 64 is passed through the second member right marginal end portion and through holes provided through the legs of member 62 to pivotally mount member 62 on the second member left marginal end portion. The clamp 63 includes an arcuate bearing plate 65 adapted to bear against the object, and a threaded member 66 engaged with the base of member 62 and selectively operable to force the bearing plate 65 leftwardly so that the object may be securely captured between the right end of the second member and this bearing plate. In this manner, the clamp means 61 may be used to releasably join and secure the object to the second member right marginal end portion.

The inventive connecting device 10 may, if desired, further include an eye 68 mounted on the third member and secured in this position by a nut 69 threaded onto the distal end of its shank portion, and a brace 70 having one marginal end portion 71 secured to the wall and having another marginal end portion 72 secured to eye 68. In the preferred embodiment, this brace may simply comprise an elongated externally-threaded rod having its left marginal end portion 71 matingly received in an anchor member 73 suitably secured to the wall, and having its right marginal end portion 72 penetrating eye 68 and retained in this position by a pair of nuts 74 on either side of the eye 68. This brace 70 has two principal functions: first, to prevent unintended rotation of the third member relative to the second member; and second, to impart lateral stability to the connecting device, much in the same manner as the diagonal bracing of the scaffold assembly. Of course, undesired rotation of the third member relative to the second member may also be restrained by a bolt or the suitable fastener (not shown) penetrating these two members.

Referring now principally to FIG. 7, the length of the connecting device 10 may be coarsely varied by adjusting the interlock means to vary the extent of longitudinal overlap between the first and third members, and such length may be finely adjusted by merely rotating the third member relative to the second member. Thus, in FIG. 7, if it is desired to change an initial length $L_1$ of the connecting device 10 (illustrated in solid) to a greater length $L_2$ (illustrated in phantom), an operator may first adjust the interlock means, if necessary, to vary the extent of overlap between the first and third members, and may thereafter rotate the third member relative to the second member, as necessary, to cause the first member cooperative threaded portion 35 to rotate relative to the stationary threaded portion, the number of turns determining the extent of elongation of the connecting device. When properly joined by the interlock means, the first and third members will rotate together, while the rotation means will enable free relative rotation between the second and third members. Thus, the effective length of the connecting device may be varied by suitably adjusting the interlock means and/or by rotating the third member relative to the second member. Of course, the length of the connecting device determines the effective spacing between the wall and the object.

In this manner, the inventive connecting device is adapted to maintain an object, such as a scaffold assembly, at a spaced distance from a wall. While in the preferred embodiment, the left marginal end portion of the first member is connected to threaded portion 28, and the right marginal end portion of the second member is connected to the object, the connecting device could alternatively be reversed with the first member engaging the object and the second member engaging the wall. Of course, in this alternative embodiment the exposed threaded portion 28 would be suitably mounted on the object. The first, second and third members may, alternatively, have other tubular or non-tubular shapes, and should therefore not be limited to the precise structure of the disclosed embodiment. If tubular, however, the third member might, alternatively, be telescopically received in one or both of the first and second members, if desired. The particular types of fasteners shown and described in the preferred embodiment are not deemed to be critical, and other functionally equivalent fasteners or mechanisms may be substituted therefor. Finally, while the illustrated form of the rotation means is simple and inexpensive to manufacture, persons skilled in this art will readily appreciate that other known functionally-equivalent devices might be substituted therefor, if desired.

Therefore, while a preferred embodiment of the inventive connecting device has been shown and described, persons skilled in this art will readily appreciate that various modifications and changes, not limited to those mentioned above, may be made without departing from the spirit of the invention which is generically defined by the following claims.

What is claimed is:

1. A connecting device adapted to maintain an object at a selected spaced distance from a wall, one of said object and wall provided with a member having a stationary threaded portion operatively arranged to face the other of said object and wall, said device comprising:

an elongated first member having one marginal end portion provided with a cooperative threaded portion adapted to matingly engage said stationary threaded portion, and having another marginal end portion;

an elongated second member having one marginal end portion secured to the other of said object and wall, and having another marginal end portion;

an elongated third member arranged to overlap each of such other marginal end portions of said first and second members;

interlock means arranged to secure said first and third members together at any selected one of a plurality of longitudinally-spaced relative incremental positions therebetween for adjustably fixing the extent of overlap between said first and third members; and rotation means operatively arranged between said second and third members for preventing substantial relative longitudinal movement therebetween, but for permitting said third member to be freely rotated relative to said second member;

whereby the length of said connecting device may be coarsely varied by adjusting said interlock means to vary the extent of overlap between said first and third members, and may be finely adjusted by rotating said third member relative to said second member.

2. A connecting device as set forth in claim 1 wherein each of said first and third members is a cylindrical tubular member, and wherein one of said first and third members is telescopically received in the other of said first and third members.

3. A connecting device as set forth in claim 2 wherein said third member has a relatively large inside diameter, said first member has a relatively small outside diameter, and wherein said first member other marginal end portion is telescopically received in said third tubular member.

4. A connecting device as set forth in claim 1 wherein one of said first and third members is provided with a plurality of longitudinally-spaced through holes, the other of said first and third members is provided with a cooperative hole adapted to register with one of said plurality of holes as the extent of overlap between said first and third members is incrementally varied, and wherein said interlock means includes a fastener having a portion passing through said cooperative hole and any selected one of said plurality of holes to releasably fix said first and third members together.

5. A connecting device as set forth in claim 1 wherein said second member is a cylindrical tubular member having a relatively small outside diameter, said third member is a cylindrical tubular member having a relatively large inside diameter, and wherein said second member other marginal end portion is arranged in said third member.

6. A connecting device as set forth in claim 5 wherein said rotation means comprises a third plug member arranged within and secured to said third member and provided with an axial through hole, a second plug member arranged within and secured to said other marginal end portion of said second member and provided with an axial through hole, and a fastener passing through said holes of said plug members and operatively arranged to prevent substantial relative axial movement between said second and third members.

7. A connecting device as set forth in claim 1 and further comprising clamp means operatively arranged between said second member one marginal end portion and the other of said object and wall, said clamp means being pivotally mounted on said second member one marginal end portion and including a clamp adapted to selectively capture the other of said object and wall.

8. A connecting device as set forth in claim 2 and further comprising a first plug member operatively arranged in and secured to said first member one marginal end portion, said first plug member being provided with said cooperative threaded portion.

9. A connecting device as set forth in claim 1 and further comprising an eye mounted on said third member, and a brace having one marginal end portion secured to said wall and having another marginal end portion secured to said eye to prevent unintended rotation of said third member relative to said second member.

* * * * *